US010148043B2

(12) United States Patent
Zhao

(10) Patent No.: US 10,148,043 B2
(45) Date of Patent: Dec. 4, 2018

(54) ELECTRICAL CONNECTOR WITH EXTENDED GROUNDING CONTACT TOUCHING SHELL

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/835,415

(22) Filed: Dec. 7, 2017

(65) Prior Publication Data

US 2018/0159278 A1 Jun. 7, 2018

(30) Foreign Application Priority Data

Dec. 7, 2016 (CN) ..... 2016 1 1114478

(51) Int. Cl.

| | |
|---|---|
| ***H01R 24/00*** | (2011.01) |
| ***H01R 13/6597*** | (2011.01) |
| ***H01R 13/502*** | (2006.01) |
| ***H01R 13/627*** | (2006.01) |
| *H01R 13/405* | (2006.01) |

(52) U.S. Cl.

CPC ..... *H01R 13/6597* (2013.01); *H01R 13/502* (2013.01); *H01R 13/6273* (2013.01); *H01R 13/405* (2013.01)

(58) Field of Classification Search

CPC ..... H01R 23/7073; H01R 23/725; H01R 23/6873; H01R 13/658; H01R 13/703; H01R 13/6873; H01R 2103/00

USPC ..... 439/660, 188, 108

See application file for complete search history.

(56) References Cited

U.S. PATENT DOCUMENTS

| | | | | |
|---|---|---|---|---|
| 6,905,366 | B2 * | 6/2005 | Yang | H01R 9/032 439/108 |
| 6,935,896 | B1 * | 8/2005 | Tsai | H01R 13/506 439/607.27 |
| 7,530,844 | B2 * | 5/2009 | Shen | H01R 13/5045 439/598 |
| 9,502,837 | B2 * | 11/2016 | Kao | H01R 24/60 |
| 2015/0288107 | A1 * | 10/2015 | Wu | H01R 13/6593 439/357 |

FOREIGN PATENT DOCUMENTS

| | | |
|---|---|---|
| CN | 104979663 A | 10/2015 |
| CN | 105470688 A | 4/2016 |

* cited by examiner

*Primary Examiner* — Hien Vu

(74) *Attorney, Agent, or Firm* — Wei Te Chung; Ming Chieh Chang

(57) ABSTRACT

An electrical plug connector for mating with a complementary receptacle connector, includes an insulative housing enclosed within a metallic shell and forming a mating cavity and two rows of contacts disposed in the housing by opposite sides of the mating cavity in the vertical direction. The grounding contact includes a first contacting section for contacting the corresponding terminal of the complementary receptacle connector and a second contacting section in front of the first contacting section for contacting the grounding collar of the complementary receptacle connector wherein the second contacting section is optionally connected to the metallic shell.

9 Claims, 12 Drawing Sheets

A

| A12 | A11 | A10 | A9 | A8 | A7 | A6 | A5 | A4 | A3 | A2 | A1 |
|---|---|---|---|---|---|---|---|---|---|---|---|
| GND | RX2+ | RX2− | VBus | SBU1 | D− | D+ | CC | VBus | TX1− | TX1+ | GND |
| GND | TX2+ | TX2− | VBus | VCONN | | | SBU2 | VBus | RX1− | RX1+ | GND |
| B1 | B2 | B3 | B4 | B5 | B6 | B7 | B8 | B9 | B10 | B11 | B12 |

B

| A12 | A11 | A10 | A9 | A8 | A7 | A6 | A5 | A4 | A3 | A2 | A1 |
|---|---|---|---|---|---|---|---|---|---|---|---|
| GND | | | VBus | SBU1 | D− | D+ | CC | VBus | | | GND |
| GND | | | VBus | VCONN | | | SBU2 | VBus | | | GND |
| B1 | B2 | B3 | B4 | B5 | B6 | B7 | B8 | B9 | B10 | B11 | B12 |

C

| A12 | A11 | A10 | A9 | A8 | A7 | A6 | A5 | A4 | A3 | A2 | A1 |
|---|---|---|---|---|---|---|---|---|---|---|---|
| GND | | | VBus | | D− | D+ | CC | VBus | | | GND |
| GND | | | VBus | VCONN | | | | VBus | | | GND |
| B1 | B2 | B3 | B4 | B5 | B6 | B7 | B8 | B9 | B10 | B11 | B12 |

D

| A12 | A11 | A10 | A9 | A8 | A7 | A6 | A5 | A4 | A3 | A2 | A1 |
|---|---|---|---|---|---|---|---|---|---|---|---|
| GND | | | VBus | | | | CC | VBus | | | GND |
| GND | | | VBus | | | | | VBus | | | GND |
| B1 | B2 | B3 | B4 | B5 | B6 | B7 | B8 | B9 | B10 | B11 | B12 |

FIG. 12

ELECTRICAL CONNECTOR WITH EXTENDED GROUNDING CONTACT TOUCHING SHELL

1. FIELD OF THE DISCLOSURE

The invention is related to an electrical connector, and particularly to the electrical connector with the extended grounding contact to touch the metallic shell.

2. DESCRIPTION OF RELATED ARTS

Chinese patent application publication CN104979663 discloses the electrical connector with a grounding spring plates of the plug connector for mating with the grounding collar of the receptacle connector. CN105470668 discloses the grounding contact is unitarily formed with an additional grounding beam in a side by side manner for touching the shell. Anyhow, such an arrangement complicates manufacturing disadvantageously.

It is desired to provide an electrical connector with a grounding structure associated with the grounding contact which is easy for manufacturing and operation.

SUMMARY OF THE DISCLOSURE

To achieve the above desire, an electrical plug connector for mating with a complementary receptacle connector, includes an insulative housing enclosed within a metallic shell and forming a mating cavity and two rows of contacts disposed in the housing by opposite sides of the mating cavity in the vertical direction. The grounding contact includes a first contacting section for contacting the corresponding terminal of the complementary receptacle connector and a second contacting section in front of the first contacting section for contacting the grounding collar of the complementary receptacle connector wherein the second contacting section is optionally connected to the metallic shell. The distance between the first contacting sections of the corresponding two grounding contacts which are aligned in the vertical direction, is smaller than that between the second contacts sections of the same corresponding two grounding contacts in the vertical direction.

BRIEF DESCRIPTION OF THE DRAWINGS

FIG. 12 is a diagram of the contact assignment.

DETAILED DESCRIPTION OF THE PREFERRED EMBODIMENT

Figure 1:
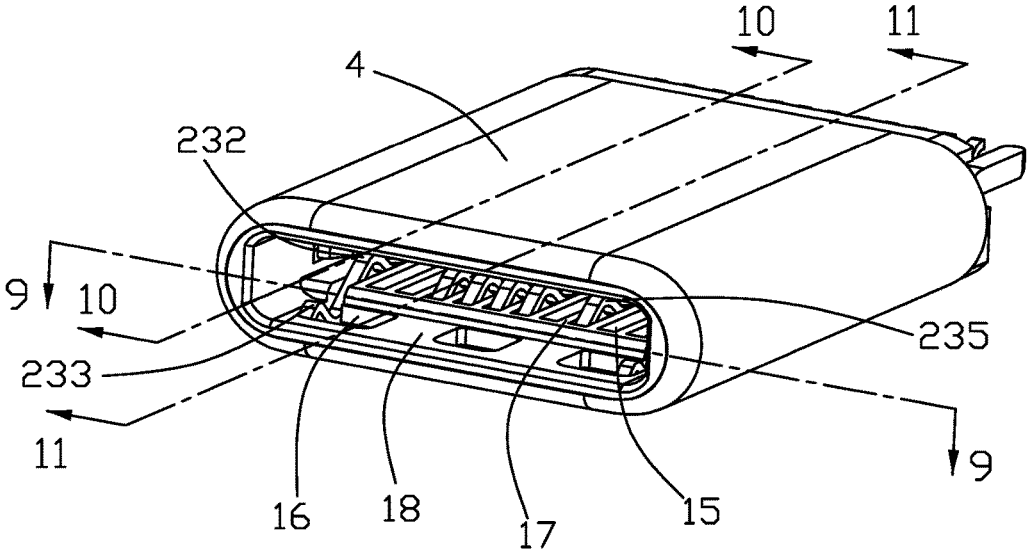
FIG. 1 is a front perspective view of an electrical connector according to the invention.
Figure 2:
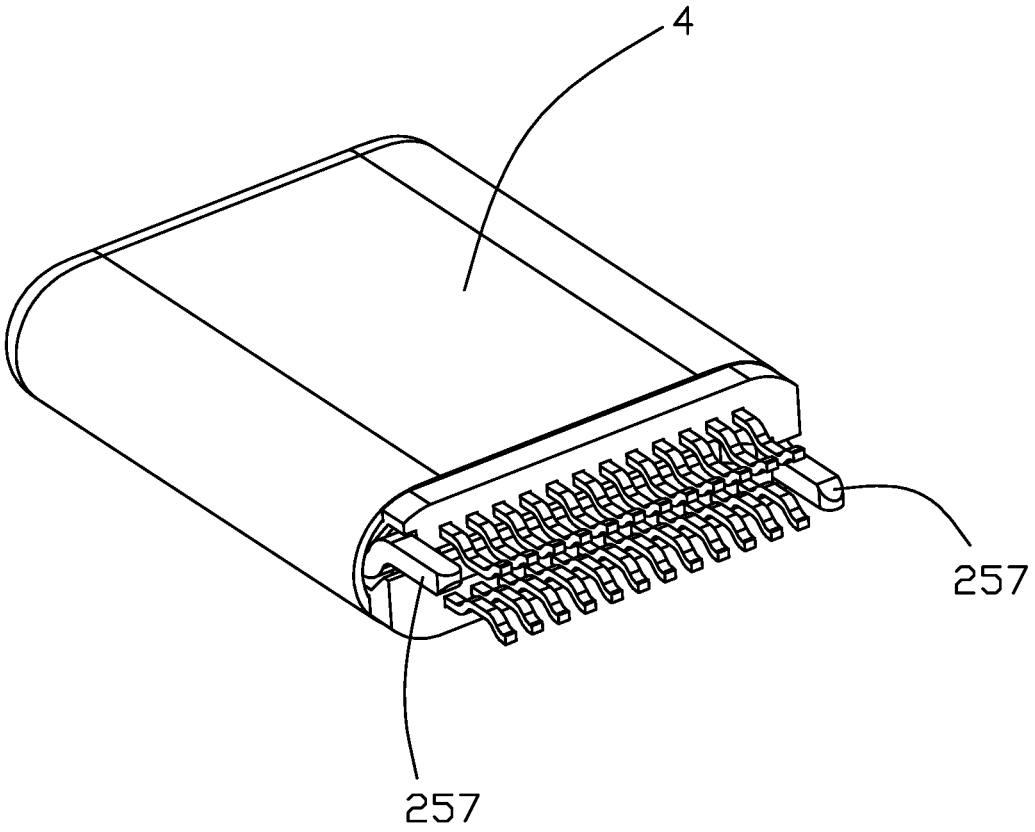
FIG. 2 is a rear perspective view of the electrical connector of FIG. 1.
Figure 3:
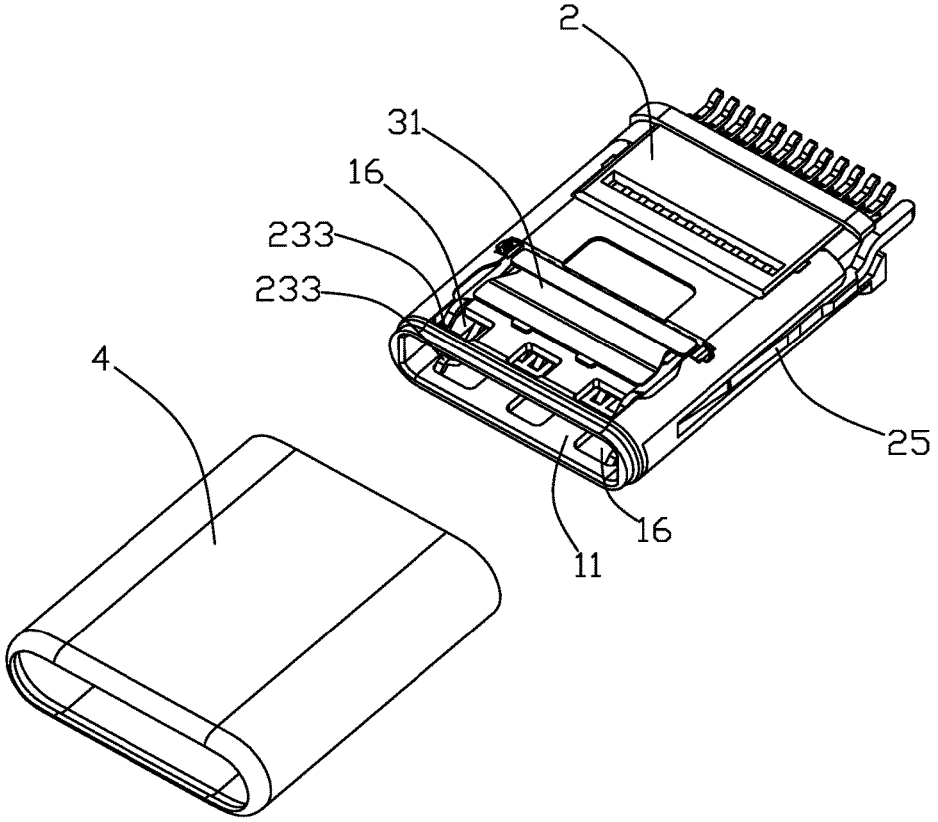
FIG. 3 is an exploded perspective view of the electrical connector of FIG. 1.
Figure 4:
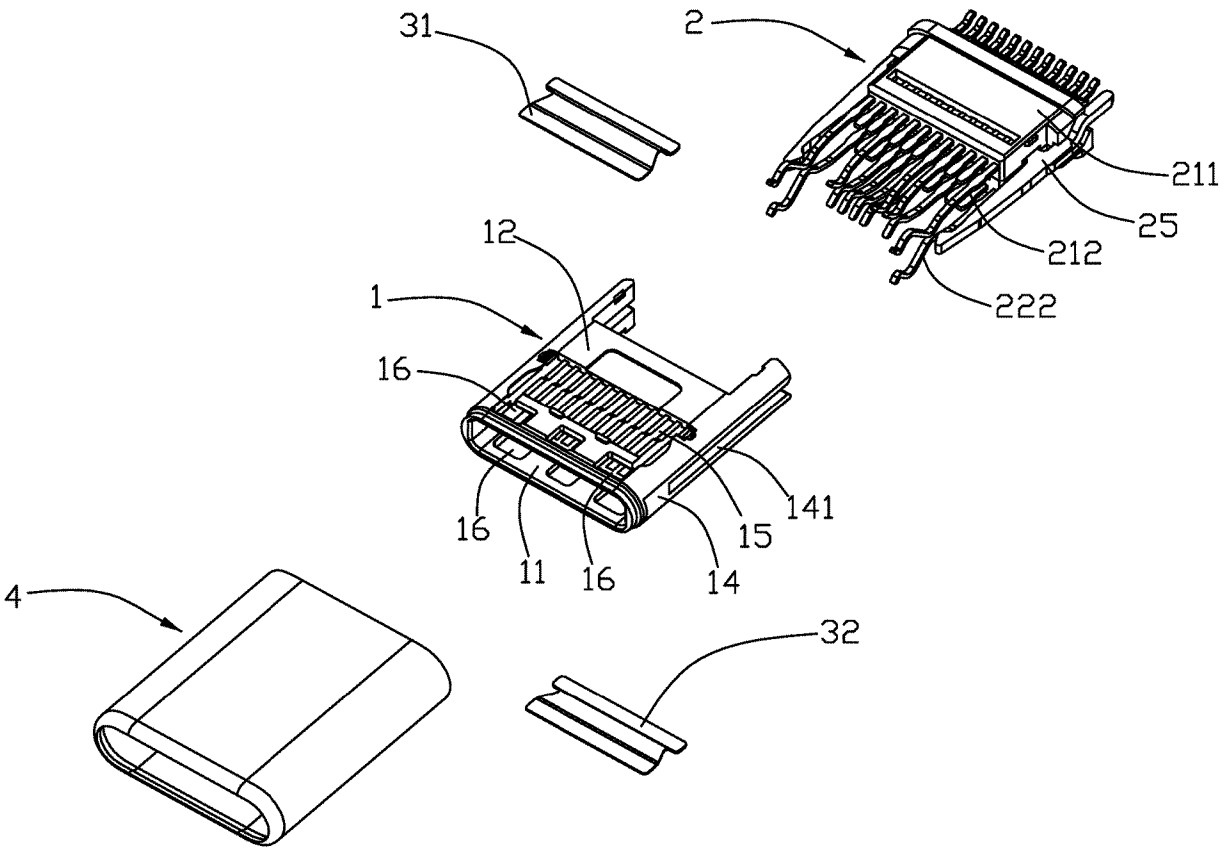
FIG. 4 is a further exploded perspective view of the electrical connector of FIG. 1.
Figure 5:
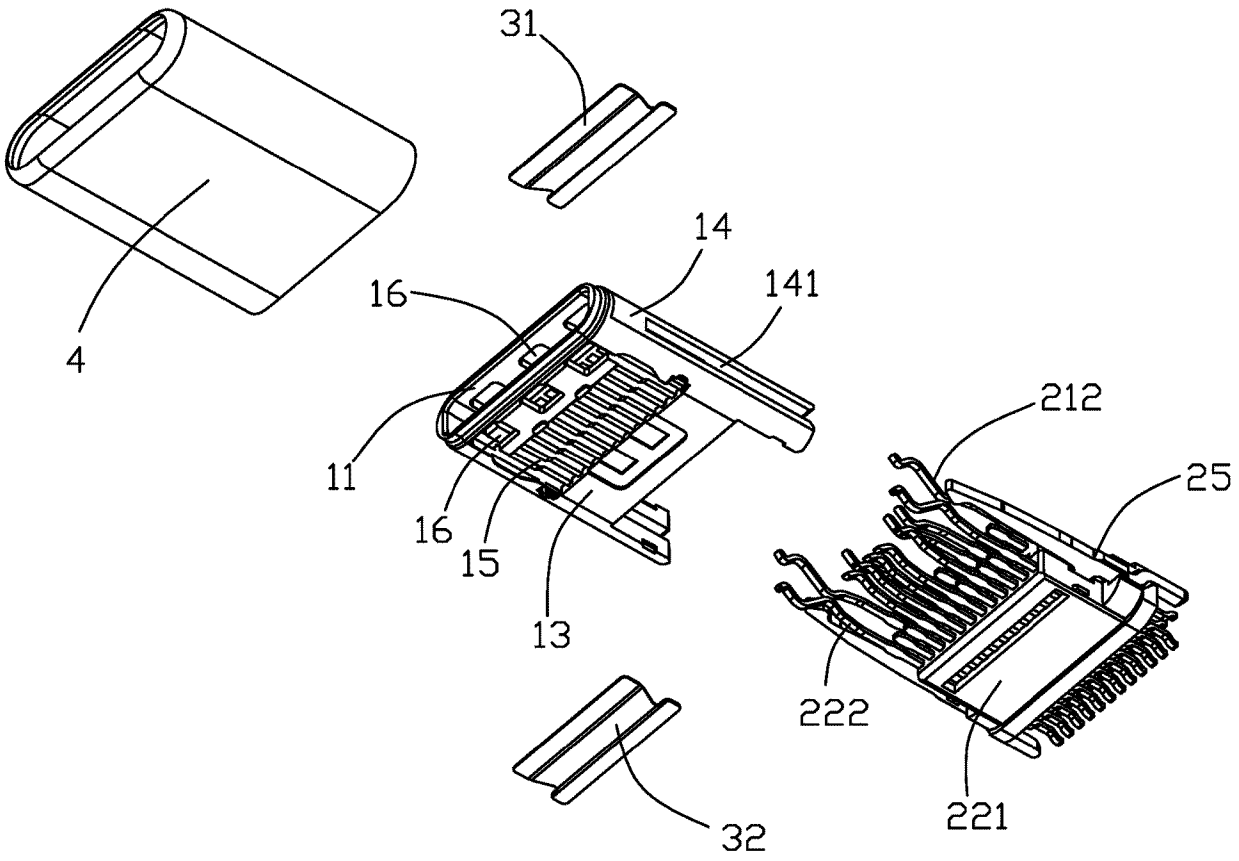
FIG. 5 is another exploded perspective view of the electrical connector of FIG. 4.

Reference will now be made in detail to the embodiments of the present disclosure. Referring to FIGS. 1-11, an electrical plug connector 100 for mating with a receptacle connector (not shown) includes an insulative housing 1, the contact module 2, the upper isolating plate 31 and the lower isolating plate 32 and the metallic shell 4.

The insulative housing 1 includes a mating cavity 11 extending through a front end to the exterior, opposite top wall 12 and bottom wall 13, and two side walls 14 connecting the top wall 12 and the bottom wall 13. The top wall 12 and the bottom wall 13 form a plurality of passageways 15, and a plurality of grooves 16 located in front of some of the passageways 15, respectively. The side wall 14 forms a locking slot 141 communicating with the mating cavity 11. The mating cavity 11 defines a horseracing track configuration. Each of the top wall 12 and the bottom wall 13 forms a first platform 17 and a second platform 18 in front of the first platform 17 with a step structure therebetween.

Figure 6:
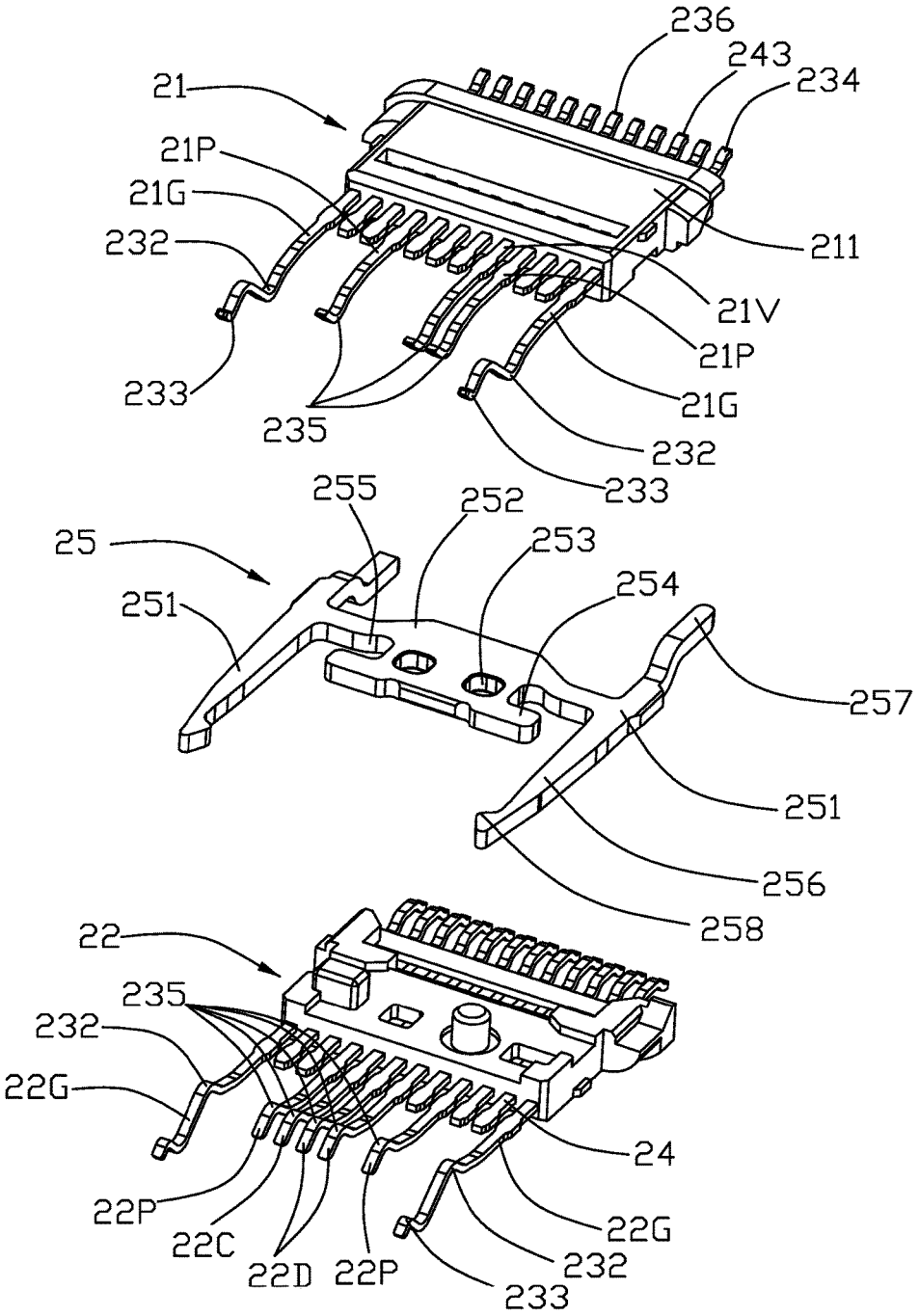
FIG. 6 is a front downward exploded perspective view of the contact module of the electrical connector of FIG. 5.
Figure 7:
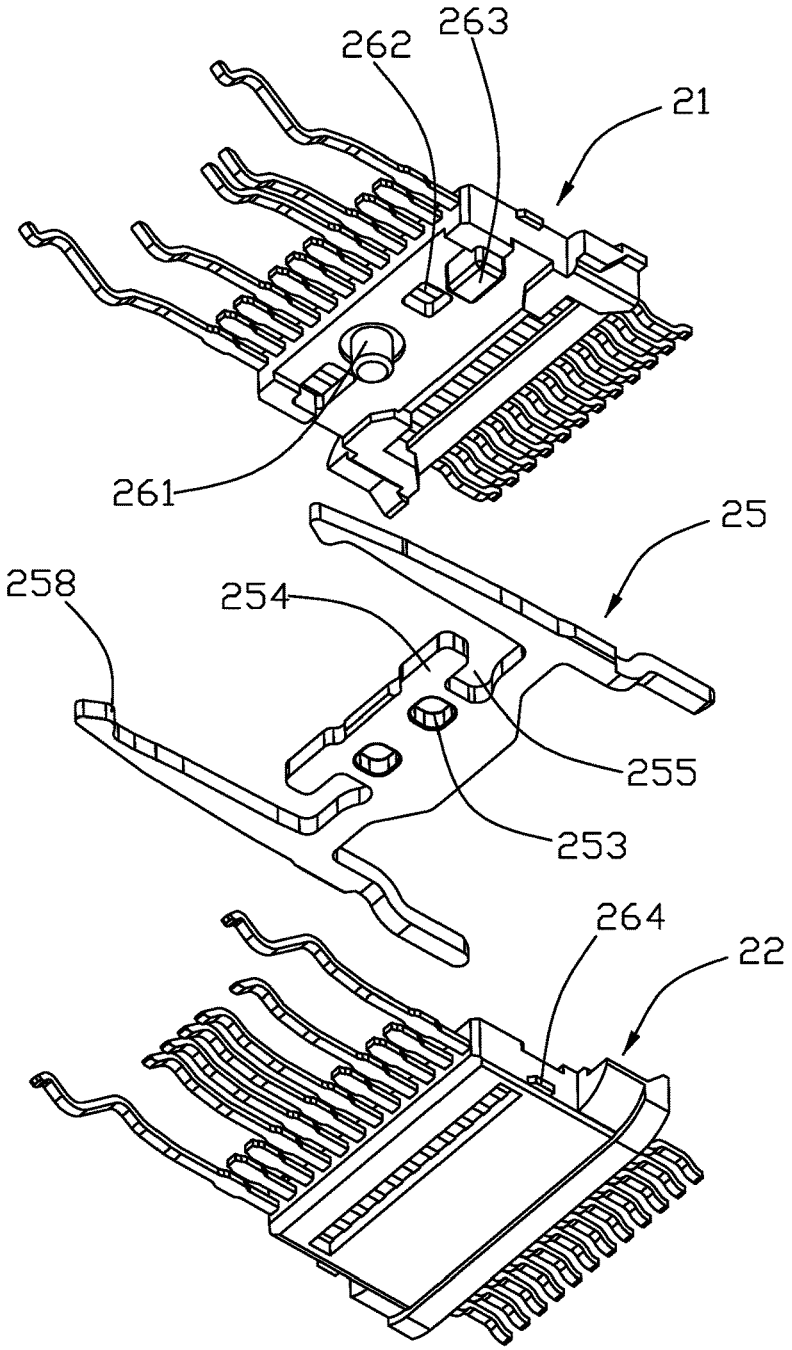
FIG. 7 is a front upward exploded perspective view of the contact module of the electrical connector of FIG. 5
Figure 8:
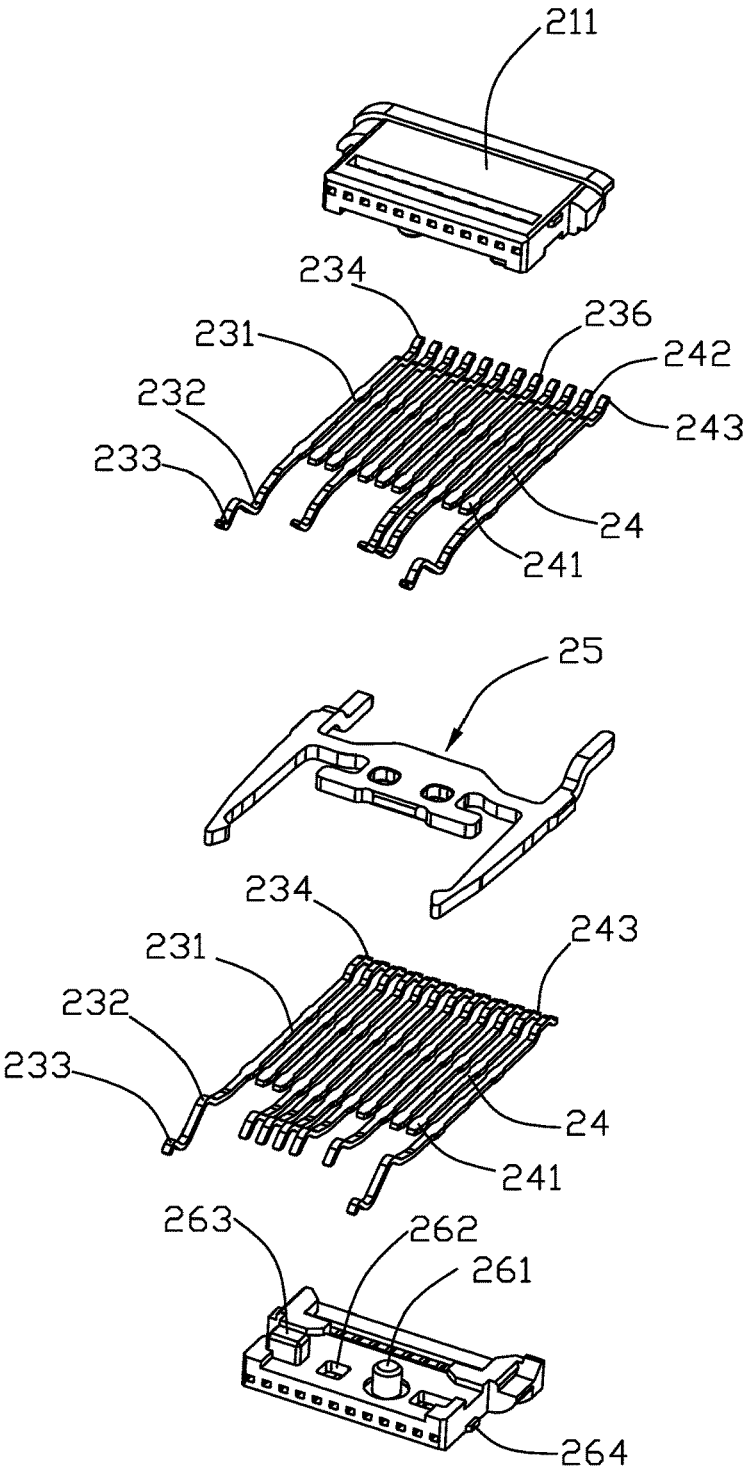
FIG. 8 is a further exploded perspective view of the contact module of the electrical connector of FIG. 7.
Figure 9:
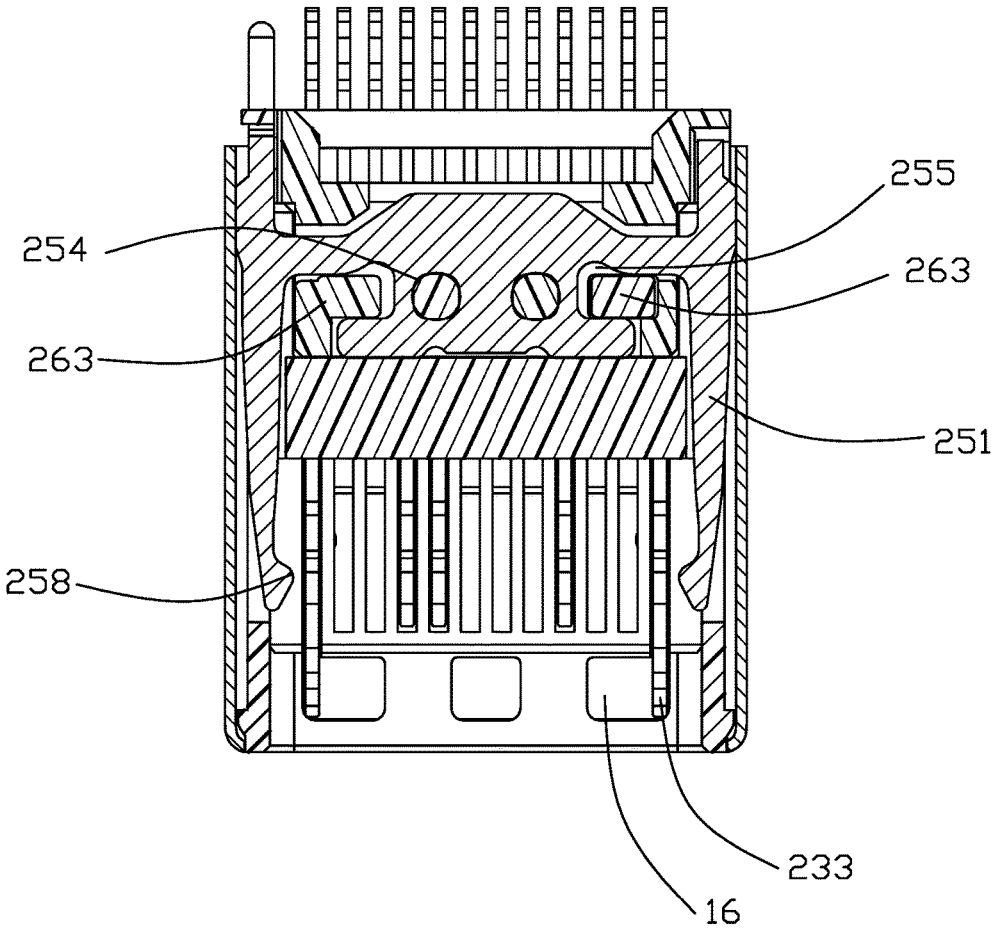
FIG. 9 is a cross-sectional view of the electrical connector of FIG. 1.
Figure 10:
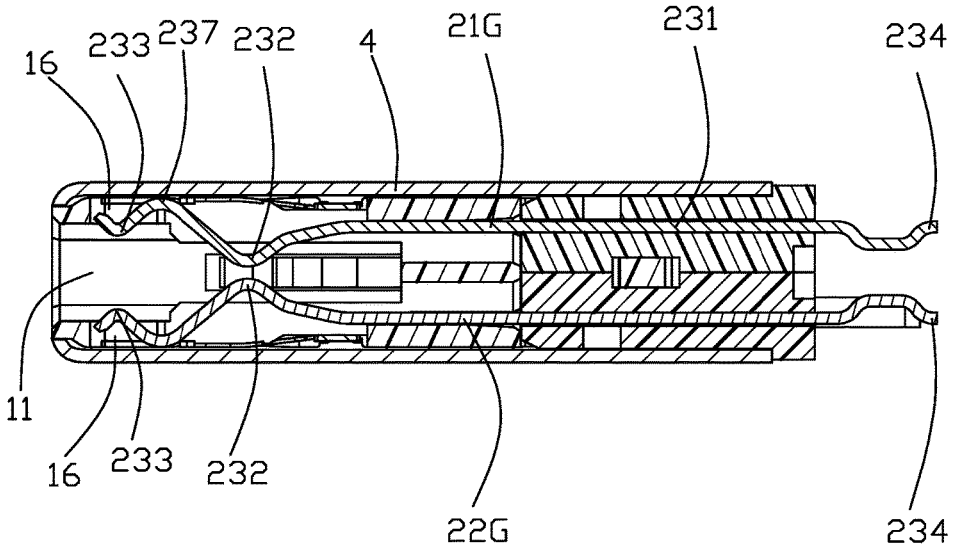
FIG. 10 is another cross-sectional view of the contact module of the electrical connector of FIG. 1.
Figure 11:
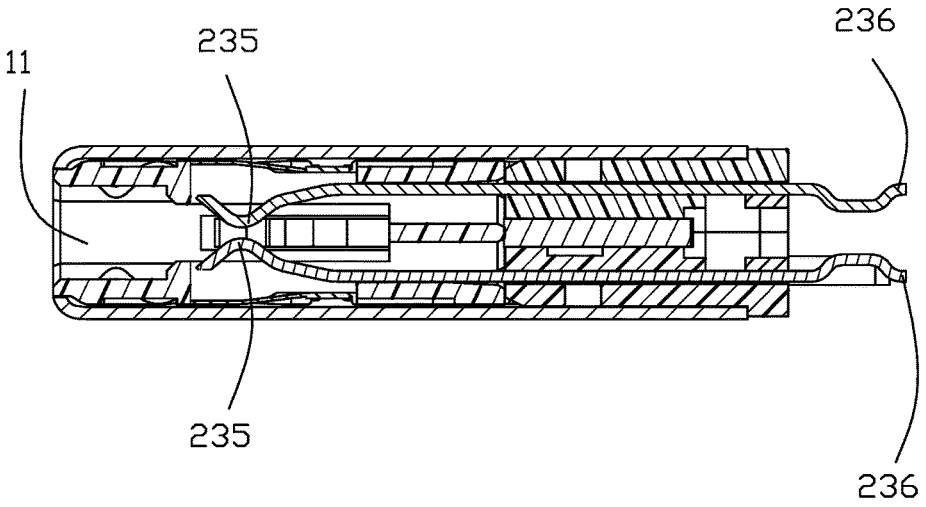
FIG. 11 is a cross-sectional view of the electrical connector of FIG. 1.

The contact module 2 includes an upper contact module 21, a lower contact module 22, and a locking piece 25 therebetween. The upper contact module 21 includes an upper insulator 211 and a plurality of upper contacts 212 integrally formed therewith via an insert-molding process, and the lower contact module 22 includes a lower insulator 221 and a plurality of lower contacts 222 integrally formed therewith via another insert-molding process. The upper contacts 212 and the lower contacts 222 are located in the upper wall 12 and the lower wall 13, respectively. Referring to FIGS. 6 and 12, the upper contacts 212 include two grounding contacts 21G, two power contacts 21P between the two grounding contacts 21G, and a VConn contact 21V. Similarly, the lower contacts 222 include two grounding contacts 22G, two power contacts 22P between the two grounding contacts 22G, and two USB 2.0 signal contacts and a detect contact 22C.

The grounding contact 21G, 22G includes the retaining section 231 retained to the upper insulator 211 and the lower insulator 221, the first resilient contacting section 232 extending from the retaining section 231 into the mating cavity 11, the second resilient contacting section 233 extending from the first resilient contacting section 232, the soldering section 234 extending rearwardly from the retaining section 231 beyond the upper insulator 211 or the lower insulator 221. The first contacting section 232 is for contacting the corresponding terminal of the complementary receptacle connector (not shown), and the second contacting section 233 is for contacting the grounding collar of the complementary receptacle connector (not shown). Understandably, the second contacting section 233 may replace the conventional spring plate as shown in the aforementioned first CN patent or the side grounding beam as shown in the aforementioned second CN patent. Notably, the distance between the first contacting section 232 of the upper contact 212 and that of the lower contact 222 is smaller than the distance between the second contacting section 233 of the upper contact 212 and that of the lower contact 222.

The power contact 21P of the upper contact 212 and the VConn contact 21V include the third contacting sections 235 aligned, in the transverse direction, with the first contacting sections 232, and the solder section 234 aligned, in the transverse direction, with the soldering section 236. Similarly, the power contact 22P of the lower contact 222, the USB 2.0 contacts 22D and the detect contact 22C include the third contacting section 235 aligned with the first contacting sections 232, and the soldering section 234 aligned with the soldering section 236. The first contacting sections 232 and the third contacting sections 235 extend from the corresponding passageways 15 into the mating cavity 11, and the second contacting sections extend from the corresponding grooves 16 into the mating cavity 11. As shown in FIG. 1, the first contacting section 232 extends from the first platform 17 into the mating cavity 11, and the second contacting section 233 extends from the second platform 18 into the mating cavity 11. Notably, the passageways 15 are formed in the first platform 17 and the grooves 16 are formed in the second platform 18. The grooves 16 communicate with the passageways 15 receiving the grounding contacts 21G, 22G.

The upper contacts 212 and the lower contacts 222 include some dummy contacts 24 each including a front section 241 located behind the first contacting section 232, and a rear soldering section 243 which are aligned with the soldering sections 234 and 236.

The locking piece 25 includes two locking arms 251 and a main part 252 therebetween. The main part 252 includes two holes 253 and two ribs 254. A restriction slot 255 is formed between the rib 254 and the main part 252. The upper insulator 211 and the lower insulator 221 include the positioning posts 261 and the positioning holes 262, wherein the positioning posts extend through the holes 252 into the positioning holes 262. The upper insulator 211 and the lower insulator 221 form the restriction blocks 263 received within the corresponding restriction slots 255, and the interference blocks 264. The locking arm 251 includes a spring arm 256 extending from the main part 252 with the hook 258 for engagement with the complementary receptacle connector, and a soldering arm 257 extending rearwardly form the main part 252 for soldering to a paddle card behind the connector 100.

The upper isolating plate 31 and the lower isolating plate 32 covers the passageways 15 of the top wall 12 and the bottom wall 13 for avoiding shorting between the shell 4 and the upper contacts 212 and the lower contacts 222.

The shell 4 is tubular. A shell contacting section 237 is formed between the first contacting section 232 and the second contacting section 233 to contact the shell 4. Notably, the bending curve formed on the shell contacting section 237 is opposite to those of the first contacting section 232 and the second contact section 233.

FIG. 12 show other type contact arrangements in (A), (B) and (C) other than (D) which reflects the embodiment of the instant invention.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. A plug connector comprising:

an insulative housing including opposite top wall and bottom wall with a mating cavity therebetween in a vertical direction;

a metallic shell enclosing the housing;

a plurality of contacts including upper contacts disposed in the upper wall, and a plurality of lower contacts disposed in the lower wall, each of said upper contacts and said lower contacts including at least a unitary grounding contact which has a first contacting section and a second contacting section in front of the first contact section in a front-to-back direction perpendicular to said vertical direction;

wherein along the said vertical direction, a distance between the first contacting section of the upper contacts and that of the lower contacts is smaller than another distance between the second contacting section of the upper contacts and that of the lower contacts;

wherein each of the top wall and the bottom wall includes a first platform where the first contacting section protrudes into the mating cavity in the vertical direction, and a second platform where the second contacting section protrudes into the mating cavity in the vertical direction, and a step is formed between the first platform and the second platform;

wherein each of the top wall and the bottom wall includes a plurality of passageways to receive the corresponding contacts therein, and at least a groove to receive the second contacting section of the corresponding grounding contact, the groove communicating with the corresponding passageway in the front-to-back direction;

wherein the housing includes an upper insulator with the upper contacts integrally formed therewith to form an upper contact module, and a lower insulator with the lower contacts integrally formed therewith to form a lower contact module, and a locking piece is sandwiched between the upper contact module and the lower contact module in the vertical direction by securing between the upper insulator and the lower insulator; and wherein the contacts further include a plurality of power contacts having corresponding third contacting sections aligned with the first contacting section of the grounding contact in a transverse direction perpendicular to both said vertical direction and said front-to-back direction.

2. The plug connector as claimed in claim 1, wherein in the vertical direction, a distance between the first platform of the top wall and that of the bottom wall is smaller than another distance between the second platform of the top wall and that of the bottom wall.

3. The plug connector as claimed in claim 1, wherein each of the grounding contacts further includes a shell contacting section between the first contacting section and the second contacting section in the front-to-back direction to contact the shell.

4. The plug connector as claimed in claim 3, wherein said shell contacting section is closer to the second contacting section than to the first contacting section in the front-to-back direction.

5. The plug connector as claimed in claim 1, wherein the upper insulator and the lower insulator are located behind the housing in the front-to-back direction.

6. A plug connector comprising:

an insulative housing including opposite top wall and bottom wall with a mating cavity therebetween in a vertical direction;

a metallic shell enclosing the housing;

a plurality of contacts including upper contacts disposed in the upper wall, and a plurality of lower contacts disposed in the lower wall, each of said upper contacts and said lower contacts including at least a grounding contact which has a first contacting section and a second contacting section in front of the first contact section in a front-to-back direction perpendicular to said vertical direction;

wherein each of the top wall and the bottom wall includes a first platform where the first contacting section protrudes into the mating cavity in the vertical direction, and a second platform where the second contacting section protrudes into the mating cavity in the vertical direction, and a step is formed between the first platform and the second platform;

wherein each of the top wall and the bottom wall includes a plurality of passageways to receive the corresponding contacts therein, and at least a groove to receive the second contacting section of the corresponding grounding contact, the groove communicating with the corresponding passageway in the front-to-back direction;

wherein the housing includes an upper insulator with the upper contacts integrally formed therewith to form an upper contact module, and a lower insulator with the lower contacts integrally formed therewith to form a lower contact module, and a locking piece is sandwiched between the upper contact module and the lower contact module in the vertical direction by securing between the upper insulator and the lower insulator;

wherein the upper insulator and the lower insulator are located behind the housing in the front-to-back direction;

wherein the contacts further include a plurality of power contacts having corresponding third contacting sections aligned with the first contacting section of the grounding contact in a transverse direction perpendicular to both said vertical direction and said front-to-back direction.

7. The plug connector as claimed in claim 6, wherein in the vertical direction, a distance between the first platform of the top wall and that of the bottom wall is smaller than another distance between the second platform of the top wall and that of the bottom wall.

8. The plug connector as claimed in claim 6, wherein each of the grounding contacts further includes a shell contacting section between the first contacting section and the second contacting section in the front-to-back direction to contact the shell.

9. The plug connector as claimed in claim 8, wherein said shell contacting section is closer to the second contacting section than to the first contacting section in the front-to-back direction.

* * * * *